US007676178B2

(12) United States Patent
Tanaka

(10) Patent No.: US 7,676,178 B2
(45) Date of Patent: Mar. 9, 2010

(54) TONER CARTRIDGE HAVING GRIP, EXCHANGEABLY INSERTED INTO REVOLVER AND REPLENISHING TONER INTO DEVELOPING DEVICE

(75) Inventor: Yoshiaki Tanaka, Numazu (JP)

(73) Assignees: Kabushiki Kaisha Toshiba, Tokyo (JP); Toshiba Tec Kabushiki Kaisha, Tokyo-To (JP)

( * ) Notice: Subject to any disclaimer, the term of this patent is extended or adjusted under 35 U.S.C. 154(b) by 4 days.

(21) Appl. No.: 11/984,153

(22) Filed: Nov. 14, 2007

(65) Prior Publication Data

US 2008/0187331 A1 Aug. 7, 2008

Related U.S. Application Data

(63) Continuation of application No. 10/787,360, filed on Feb. 27, 2004, now Pat. No. 7,327,975.

(30) Foreign Application Priority Data

Feb. 28, 2003 (JP) ..... 2003-053521
Feb. 28, 2003 (JP) ..... 2003-053671

(51) Int. Cl.
*G03G 15/08* (2006.01)

(52) U.S. Cl. ..... 399/227

(58) Field of Classification Search ..... 399/227, 399/119

See application file for complete search history.

(56) References Cited

U.S. PATENT DOCUMENTS 4,819,019 A * 4/1989 Egawa et al. ..... 347/118
4,916,490 A * 4/1990 Tanaka et al. ..... 399/119
5,040,024 A 8/1991 Fukuda et al.
5,752,141 A 5/1998 Nishimura et al.
6,085,056 A 7/2000 Okada
6,188,859 B1 2/2001 Wang et al.
6,229,976 B1 5/2001 Kimura
6,246,848 B1 * 6/2001 Morinaga et al. ..... 399/106
6,408,142 B1 6/2002 Takeuchi et al.
6,526,243 B2 2/2003 Kim et al.
6,542,709 B1 4/2003 Wang et al.
6,839,534 B2 1/2005 Matsuda et al.
6,892,036 B2 5/2005 Ito
2003/0063927 A1 4/2003 Wang et al.
2004/0009017 A1 1/2004 Yoshino et al.

FOREIGN PATENT DOCUMENTS

JP 61-180252 A 8/1986
JP 03-024663 U 3/1991
JP 03-069162 U 7/1991
JP 03-077964 U 8/1991

(Continued)

*Primary Examiner*—Quana M Grainger
(74) *Attorney, Agent, or Firm*—Foley & Lardner LLP

(57) ABSTRACT

According to a toner cartridge of this invention, a region (R3) extending along the outer circumferential direction of a toner cartridge (50) is not tapered, and a region (R1) on the inner wall of a developing device (10) which corresponds to the region (R3) is not tapered either. This prevents the occurrence of backlash between them, and allows the shutter of the toner replenishment port of the developing device (10) to be reliably closed when the toner cartridge (50) is slid. This can therefore prevent toner from leaking and contaminating the image forming apparatus. According to a toner cartridge of this invention, a cap (60) which seals the opening portion of a casing (51) of a toner cartridge (50*a*) is formed from a transparent member. This allows an easy check of the color of toner from the front surface side of an image forming apparatus, and eliminates the necessity to add a new member for a color check, thereby contributing to a reduction in cost.

10 Claims, 14 Drawing Sheets

FOREIGN PATENT DOCUMENTS

| | | | |
|---|---|---|---|
| JP | 03-249766 | A | 11/1991 |
| JP | 05-055161 | U | 7/1993 |
| JP | 06-222665 | A | 8/1994 |
| JP | 06-258911 | A | 9/1994 |
| JP | 07-1 99622 | A | 8/1995 |
| JP | 07-199622 | A | 8/1995 |
| JP | 08-146744 | A | 6/1996 |
| JP | 09-218575 | A | 8/1997 |
| JP | 2000-187378 | A | 7/2000 |
| JP | 2001-051486 | A | 2/2001 |
| JP | 2001-235937 | A | 8/2001 |
| JP | 2002-072651 | A | 3/2002 |
| JP | 2002-214898 | A | 7/2002 |
| JP | 2003-050505 | A | 2/2003 |

* cited by examiner

TONER CARTRIDGE HAVING GRIP, EXCHANGEABLY INSERTED INTO REVOLVER AND REPLENISHING TONER INTO DEVELOPING DEVICE

The present application is a continuation of U.S. application Ser. No. 10/787,360, filed Feb. 27, 2004 the entire contents of which are incorporated herein by reference.

BACKGROUND OF THE INVENTION

The present invention relates to a toner cartridge and developing device.

Conventionally, revolver type developing devices like those described in references to be described later have been known.

In such developing devices, a plurality of cartridges are stored in the revolver. The developing devices for the respective colors rotate together with the toner cartridges.

When toner in a toner cartridge of a revolver type developing device is consumed, and the toner cartridge is to be replaced with a new toner cartridge, the rotation of the developing device is stopped. Thereafter, the interior of the device is opened to expose all the toner cartridges to the user. The user then selects a necessary one of the toner cartridges of the respective colors and replaces it with a new one.

In this case, it is required to allow the user to know the location of each cartridge at a glance, and to provide high operability in toner cartridge replacement.

Obviously, a toner cartridge is required to have an arrangement for preventing toner from spilling out when the user removes the cartridge for replacement and inserts a new toner cartridge.

As toner cartridges designed to meet such a requirement, toner cartridges like those disclosed in Japanese Patent Laid-Open Nos. 6-258911 and 8-146744 and Japanese Utility Model Laid-Open No. 3-24663 are known. In order to identify the color of toner in each of these toner cartridges, labels for displaying colors are attached to the cartridges or their caps are colored.

Alternatively, a cartridge body (to be referred to as a casing hereinafter) has a window formed from a transparent member.

Therefore, in addition to a casing and cap which are indispensable components, a member for a label or window is newly required to form a toner cartridge. Alternatively, caps of different colors are required for different kinds of toner, resulting in an increase in cost.

In addition, when a window is provided for a cartridge, the remaining amount of toner in the cartridge becomes difficult to see as it decreases depending on the position of the window or the like. This makes it difficult to identify the color of toner.

A toner cartridge is known, which has a shutter or the like covering the replenishment port to prevent toner from spilling out when the toner cartridge is replaced. When this toner cartridge is loaded in the apparatus, a portion of the apparatus moves the shutter of the toner cartridge to open the replenishment port.

More specifically, when the toner cartridge is inserted in a developing device in the apparatus, the shutter which has closed the toner replenishment port of the toner cartridge is pushed and opened by an end portion of the developing device, located near the shutter, owing to the accompanying sliding operation, and an end portion of the toner replenishment port of the toner cartridge opens the shutter which has closed the toner replenishment port of the developing device. In contrast to this, when a toner cartridge is to be removed from a developing device, the shutter which has been pushed and opened at the toner replenishment port of the toner cartridge is released by the accompanying sliding operation to be closed by a spring, and a pawl provided on the toner cartridge hooks and closes an end portion of the toner replenishment port of the developing device which is located near the shutter. Thereafter, the pawl comes off the end portion of the shutter to be released, and the toner cartridge is removed from the developing device.

Such a conventional toner cartridge is disclosed in, for example, Japanese Utility Model Laid-Open No. 03-69162.

As shown in FIG. 15A, a draft is provided on each of the outer surface of a conventional toner cartridge 201 and the inner wall of a developing device 200 throughout the entire region from near the front end on the right side in FIG. 15A (on the front surface side of the image forming apparatus) to near the rear end on the left side in FIG. 15A in consideration of the shape of a mold for injection molding in order to ensure easy mold release in the mold moving direction (longitudinal direction).

With such tapered outer shapes, when the toner cartridge 201 is inserted into the developing device 200 in the direction indicated by the arrow in FIG. 15A, no large amount of backlash occurs. Such tapered shapes therefore give no trouble in opening the shutter of the toner replenishment port of the toner cartridge 201 or opening the shutter of the toner replenishment port of the developing device 200. Let Y1 be the gap between the toner cartridge 201 and the developing device 200 when the cartridge is stored in the developing unit.

When, however, the toner cartridge 201 inserted in the developing device 200 is removed in the direction indicated by the arrow in FIG. 15B, a gap Y2 larger than the gap Y1 is produced between the inner wall of the developing device 200 and the outer surface of the toner cartridge 201, resulting in a large amount of backlash. Even in such a case, since the shutter of the toner replenishment port of the toner cartridge 201 is biased by the spring in the closing direction, the shutter can be reliably closed. However, the shutter of the toner replenishment port of the developing device 200 cannot be closed because the pawl of the toner cartridge 201 comes off the end portion near the shutter of the toner replenishment port of the developing device 200. As a consequence, toner may leak from the developing device and contaminate the interior of the image forming apparatus.

The present invention has been made in consideration of the above situation, and has as it object to provide a toner cartridge and developing device which allow easy identification of the color and remaining amount of toner in a toner cartridge of each color, provide good operability in toner cartridge replacement, and prevent toner from spilling out at the time of replacement.

SUMMARY OF THE INVENTION

According to the present invention, there is provided a toner cartridge comprising an untapered region extending from near a front end to a predetermined position along a longitudinal direction of an outer circumferential portion, and a tapered region extending from the predetermined position to near a rear end.

An inclined surface may be provided at a boundary region between said untapered region and said tapered region to connect said regions.

According to the present invention, there is provided a toner cartridge comprising a tapered portion extending from near a front end to near a rear end along a longitudinal direction of an outer circumferential portion, and a plurality of rib portions in the form of ribs formed on a region extending from the front end to a predetermined position to make a size of the region in a direction perpendicular to the longitudinal direction uniform along the longitudinal direction.

Said toner cartridge may include a toner replenishment port for replenishing toner when said cartridge is housed in a developing device, and a shutter which opens/closes the toner replenishment port, and the predetermined position may be near the toner replenishment port.

According to the present invention, there is provided a developing device which can house a toner cartridge having, on an outer circumferential portion, a first untapered region extending from near a front end to a predetermined position and a tapered region extending from the predetermined position to near a rear end, comprising a toner cartridge guide inner wall which houses the toner cartridge, said toner cartridge guide inner wall having a second untapered region in a region corresponding to the first untapered region of the toner cartridge when the toner cartridge is housed.

According to the present invention, there is provided a toner cartridge which is detachably provided in an image forming apparatus, said toner cartridge being configured to be inserted in and removed from the image forming apparatus along a longitudinal direction of said toner cartridge and having, on an outer circumference thereof, a tapered portion inclined along the longitudinal direction and an untapered portion substantially parallel to a direction to be removed.

The toner cartridge may comprise, on the outer circumference, a replenishment port for replenishing toner to the image forming apparatus, and a shutter member which covers the replenishment port, said shutter member opening/closing the replenishment port when said toner cartridge is attached/detached to/from the image forming apparatus.

According to the present invention, there is provided a toner cartridge exchangeably mounted in an image forming apparatus, comprising:

a first portion which extends in a longitudinal direction, has a substantially cylindrical shape, and contains toner;

a substantially rectangular second portion which is formed integrally with said first portion along the longitudinal direction;

a container which has a third portion integrally formed with at least part of said first portion along the longitudinal direction;

a toner agitating member provided on said first portion;

a screw provided on said third portion;

a discharge port which is formed in one end of said third portion to discharge toner conveyed by said screw;

a lid member which opens/closes said discharge port as said toner cartridge moves relative to the image forming apparatus when said toner cartridge is replaced;

a plurality of gears which are provided at one end of said container and outside said container to rotate said screw and said toner agitating member; and a cap which closes one end of said container which is located opposite to a side where said plurality of gears are provided, along a longitudinal direction of said container, has a grip with which said container can be pulled out, and allows discrimination of a color and amount of toner contained in said container.

Said container may have a tapered portion at least partly along the longitudinal direction.

Said container may have a tapered portion inclined in the longitudinal direction, and an untapered portion.

The toner cartridge may have an opening/closing member for opening/closing a replenishment port of the image forming apparatus.

The toner may be collected to a central portion of said container along the longitudinal direction by rotation of said screw and conveyed from near the central portion toward the opening portion by said screw.

DESCRIPTION OF THE PREFERRED EMBODIMENTS

Figure 1:
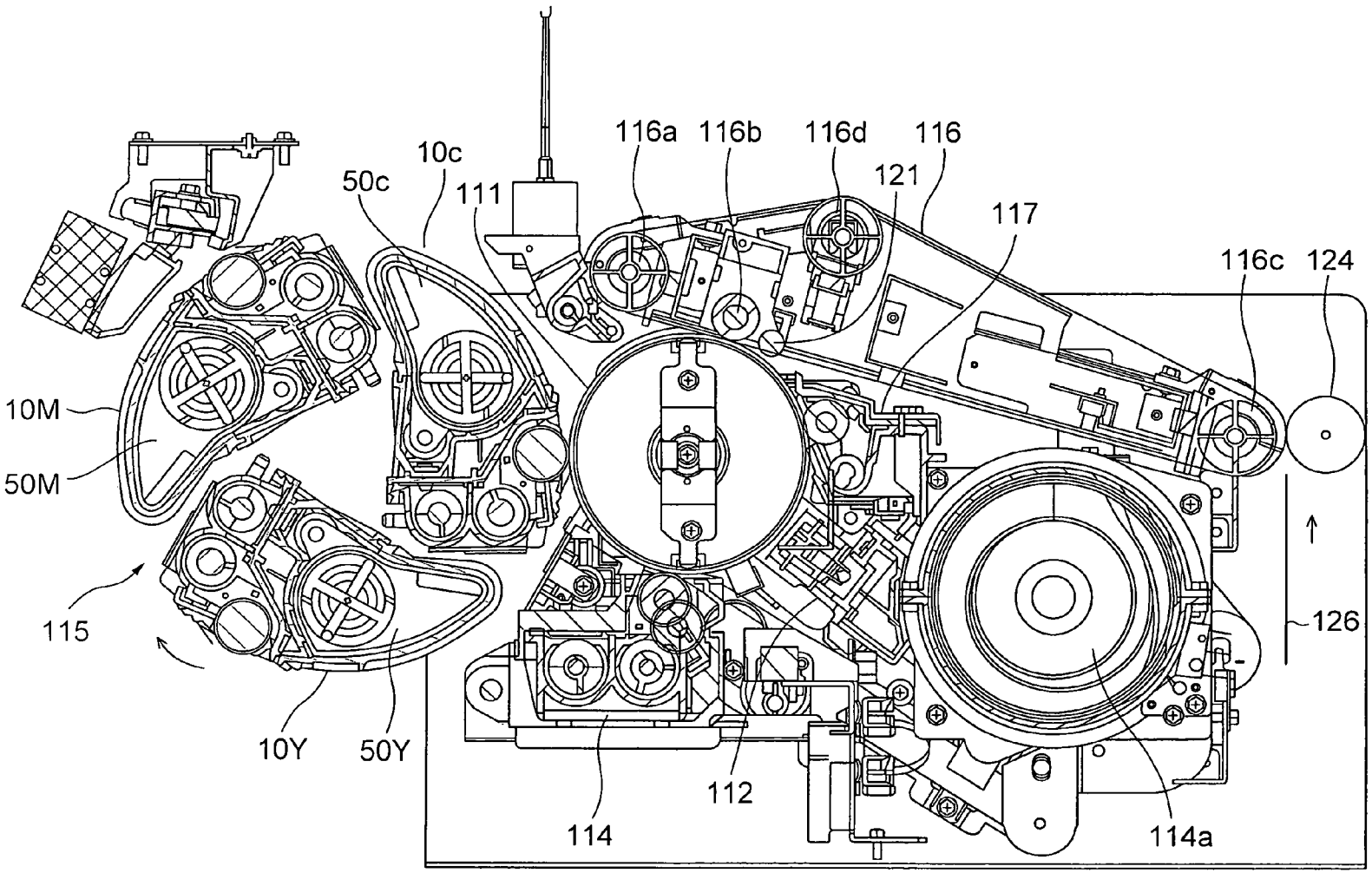
FIG. 1 is a longitudinal sectional view showing the schematic arrangement of an image forming apparatus to which the present invention can be applied.

The embodiments of the present invention will be described below with reference to the accompanying drawings.

The schematic arrangement of an image forming apparatus to which the present invention can be applied will be described first with reference to FIG. 1.

This image forming apparatus has a housing which houses a paper feed unit, two-sided unit, manual paper feed unit, and the like (not shown), in addition to a process unit.

The process unit has a photosensitive drum 111 (image carrier) having an axis extending in the front-rear direction of the image forming apparatus (a direction perpendicular to the drawing surface).

A charging device 112, exposure device (not shown), black (K) developing device 114, revolver 115, intermediate transfer belt 116, and drum cleaner 117 are arranged around the photosensitive drum 111 along the rotating direction (indicated by an arrow in FIG. 1) of the photosensitive drum 111.

The charging device 112 charges the outer drum surface of the photosensitive drum 111 at a predetermined potential.

The exposure device is placed near the lower end of the process unit and forms an electrostatic latent image based on image data by exposing the drum surface charged at the predetermined potential. In this apparatus designed to form a color image, the exposure device exposes the drum surface on the basis of color-separated image data to form electrostatic latent images of the respective colors on the drum surface.

The black developing device 114 is placed between the photosensitive drum 111 and the exposure device, i.e., placed to oppose the photosensitive drum 111 from below in the gravity direction. The black developing device 114 develops the black electrostatic latent image formed on the drum surface by supplying a black developing agent to the image, thereby forming a black developing agent image on the drum surface. Toner and a developing agent are supplied from a toner cartridge 114*a* to the black developing device 114.

The revolver 115 is rotatably placed adjacent to the photosensitive drum 111 on the left side in FIG. 1. The revolver 115 includes a yellow developing device 10Y, magenta developing device 10M, and cyan developing device 10C each having basically the same structure as that of the black developing device 114. The respective developing devices are detachably stored in the revolver 115 along the rotating direction of the revolver 115.

The respective developing devices have toner cartridges 50Y, 50M, and 50C containing toners of the respective colors and developing agents. By rotating the revolver 115 clockwise, the developing devices 10Y, 10M, and 10C of the respective colors are selectively placed to oppose the surface of the photosensitive drum 111 from a side of the photosensitive drum.

The intermediate transfer belt 116 is placed at a position where it comes into rolling contact with the photosensitive drum 111 from above in the gravity direction and is wound around a driving roller 116*a*, pre-transfer roller 116*b*, transfer opposed roller 116*c*, and tension roller 116*d* in a tensioned state. A primary transfer roller 121 is placed inside the intermediate transfer belt 116. The primary transfer roller 121 makes the intermediate transfer belt 116 come into rolling contact with the drum surface, and transfers the developing agent image formed on the drum surface onto the intermediate transfer belt 116.

A secondary transfer roller 124 is placed at a position where a vertical convey path 126 for conveying a transfer sheet is clamped between the secondary transfer roller and the transfer opposed roller 116*c* through the intermediate transfer belt 116. A fixing device (not shown) which fixes the developing agent image transferred on the transfer sheet by heating and pressurizing the image is placed on the vertical convey path 126.

In initial operation, the black developing device 114 is moved downward and separated from the drum surface, and the revolver 115 is rotated clockwise to make the yellow developing device 10Y oppose the drum surface. The secondary transfer roller 124 is moved in a direction to move away from the vertical convey path 126, and is separated from the intermediate transfer belt 116.

Image data is read from an original (not shown) through a scanner unit (not shown), or image data is input from an external device (not shown). The photosensitive drum 111 is rotated clockwise, and the drum surface is uniformly charged by the charging device 112 at a predetermined potential.

The exposure device is operated on the basis of color-separated yellow image data to form an yellow electrostatic latent image on the drum surface. Yellow toner and a developing agent are supplied to the electrostatic latent image on the drum surface through the yellow developing device 10Y to develop the yellow electrostatic latent image, thereby forming an yellow developing agent image on the drum surface. The yellow developing agent image formed on the drum surface is moved upon rotation of the photosensitive drum 111 to pass through the primary transfer region in rolling contact with the intermediate transfer belt 116. As a consequence, the yellow developing agent image on the drum surface is transferred onto the intermediate transfer belt 116. After the yellow developing agent image is transferred onto the intermediate transfer belt 116, the yellow developing agent that remains the drum surface without being transferred is removed by the drum cleaner 117.

In order to form a magenta electrostatic latent image on the drum surface, the drum surface is uniformly charged by the charging device 112, and the revolver 115 rotates to make the magenta developing device 10M opposes the drum surface.

The above exposure, development, and transfer to the intermediate transfer belt 116 are performed. As a consequence, the magenta developing agent image is superimposed and transferred on the yellow developing agent image on the intermediate transfer belt 116. After the magenta developing agent image is transferred, a cyan developing agent image is superimposed and transferred through the same process as described above.

The revolver 115 rotates to the home position where none of the developing devices 10Y, 10M, and 10C oppose the drum surface, and the black developing device 114 moves upward to oppose the drum surface. In this state, a black developing agent image is superimposed and transferred on the yellow, magenta, and cyan developing agent images on the intermediate transfer belt 116 by the same process as described above.

In this manner, the developing agent images of all the colors are superimposed on the intermediate transfer belt 116, and the secondary transfer roller 124 is moved to the left in FIG. 1 to come into rolling contact with the intermediate transfer belt 116. In this state, the developing agent images of all the colors which are superimposed on the intermediate transfer belt 116 are moved upon rotation of the intermediate transfer belt 116, and pass through the secondary transfer region between the belt and the secondary transfer roller 124. The transfer sheet is then conveyed upward along the vertical convey path 126 to be fed to the secondary transfer region. The developing agent images of the respective colors on the intermediate transfer belt 116 are then transferred onto the sheet through the secondary transfer roller 124.

The transfer sheet on which the developing agent images of all the colors are transferred passes through the fixing device to be heated and pressurized. As a result, the developing agent images of all the colors are fixed to form a color image.

In this case, as described above, the developing devices 10C, 10M, and 10Y are provided for the respective colors, i.e., cyan (C), magenta (M), and yellow (Y), and stored in the revolver 115. These developing devices rotate together with the revolver 115. The toner cartridges 50C, 50M, and 50Y respectively containing toners of the respective colors are inserted and fixed in the developing devices 10C, 10M, and 10Y, respectively.

Replacement of the toner cartridges 10C, 10M, and 10Y is performed on the front side of the image forming apparatus. The revolver 115 is rotated to cause one of the toner cartridges 50C, 50M, and 50Y which needs to be replaced to come to the toner cartridge replacement position, and a grip 61 provided on a cap 60 of the corresponding one of the toner cartridges 50C, 50M, and 50Y is pulled to be removed from the revolver 115. A new toner cartridge 50C, 50M, or 50Y is then inserted in the revolver 115.

In order to allow the toner cartridges 50C, 50M, and 50Y mounted in the revolver 115 to rotate together with the revolver 115, the toner cartridges are located inside the image forming apparatus with respect to the front-side frame. For this reason, grips are provided on the toner cartridges 50C, 50M, and 50Y to allow the user to take out the toner cartridges 50C, 50M, and 50Y located inside the apparatus when they are attached/detached.

A toner cartridge according to the first embodiment of the present invention will be described next.

As described above, the casing of a toner cartridge is shaped to have a draft from near the front end to near the rear end in consideration of the shape of a mold for injection molding so as to ensure easy mold release in the molding moving direction, i.e., the longitudinal direction of the casing.

Figure 2B:
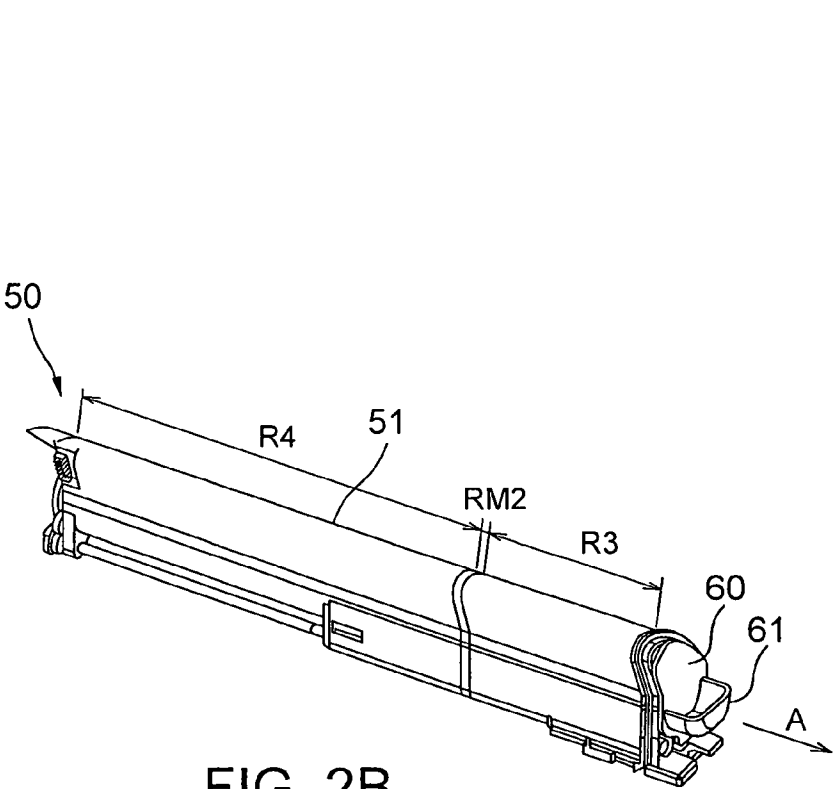
FIGS. 2A and 2B are perspective views showing the outer shapes of a toner cartridge and developing device according to the first embodiment of the present invention.
Figure 2A:
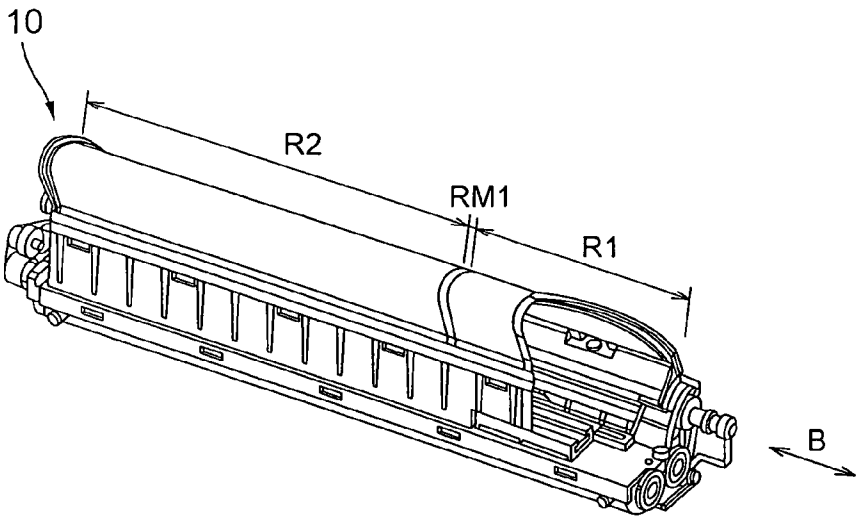

As shown in FIG. 2A, a developing device 10 in the image forming apparatus has a hollow portion for housing a toner cartridge 50. The toner cartridge 50 shown in FIG. 2B is inserted in the hollow portion of the developing device 10. The toner cartridge 50 includes a casing 51 having a hollow portion for containing toner and a lid 60 which closes the opening portion of the casing 51 which is located on the front end side. The lid 60 has a grip 61 which is pulled in the direction indicated by an arrow A by the operator.

As indicated by an arrow B, by sliding the toner cartridge 50 in the longitudinal direction, the cartridge is attached/detached to/from the developing device 10.

Figure 3:
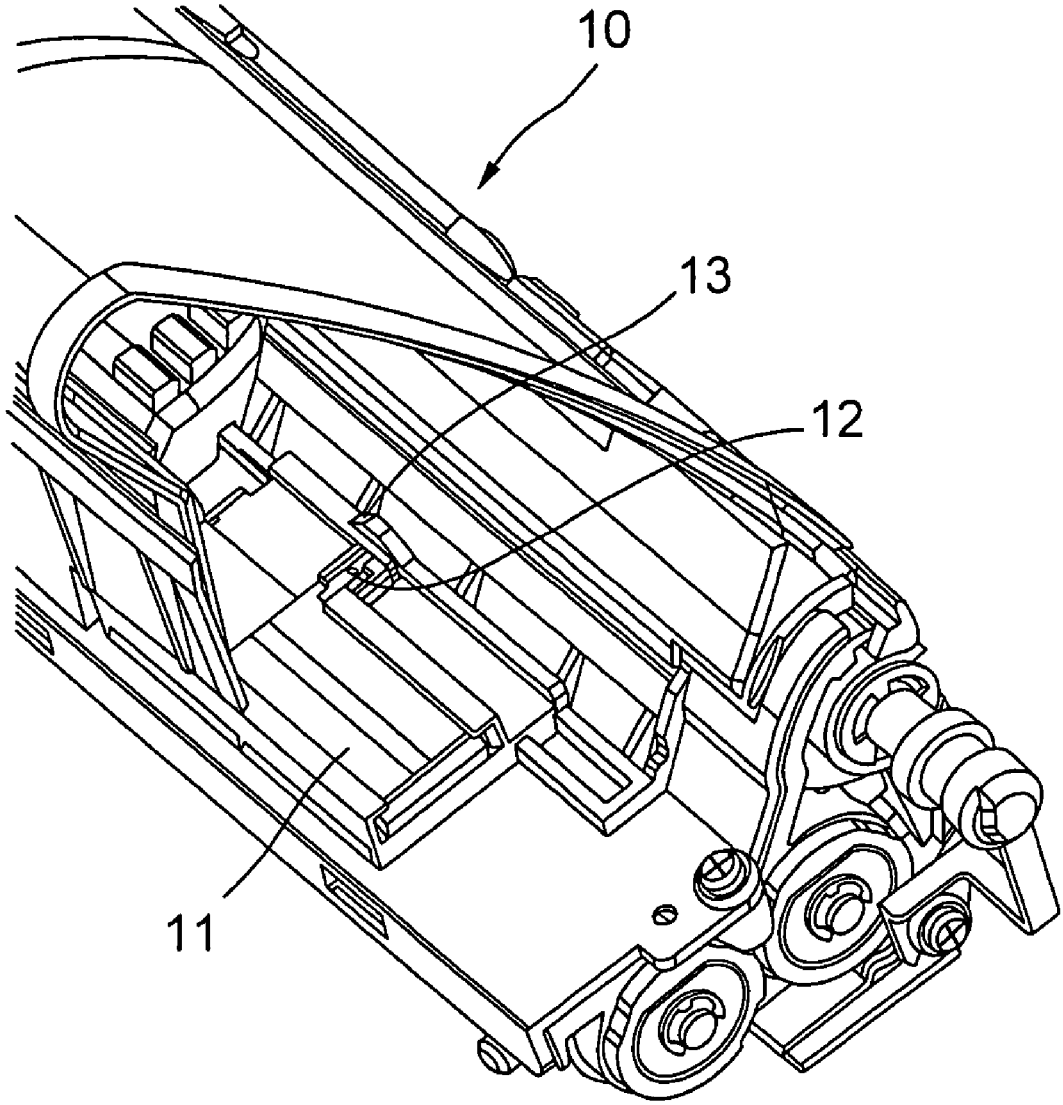
FIG. 3 is a perspective view showing the structure of a portion of the developing device which is located near the toner replenishment port.

As shown in FIG. 3, the developing device 10 has a toner replenishment port 11. When the toner cartridge 50 is inserted, the toner replenishment port of the toner cartridge 50 is coupled to the toner replenishment port 11 of the developing device 10. As a consequence, toner in the toner cartridge 50 is moved and replenished into the developing device 10.

The toner replenishment port 11 of the developing device 10 has a shutter. As the toner cartridge 50 slides in the insertion direction, an end portion of the shutter of the toner replenishment port of the toner cartridge pushes open the shutter of the developing device 10.

The shutter of the toner replenishment port of the toner cartridge 50 is biased by a spring in the direction to close the toner replenishment port. An end portion 12 and inclined surface 13 are provided near the toner replenishment port 11 of the developing device 10. The end portion 12 is locked to the pawl of the toner cartridge 50. The inclined surface 13 serves to unlock the pawl from the end portion 12 after the pawl is locked to the end portion 12 to close the shutter of the toner replenishment port 11 when the toner cartridge 50 is to be removed.

Figure 4:
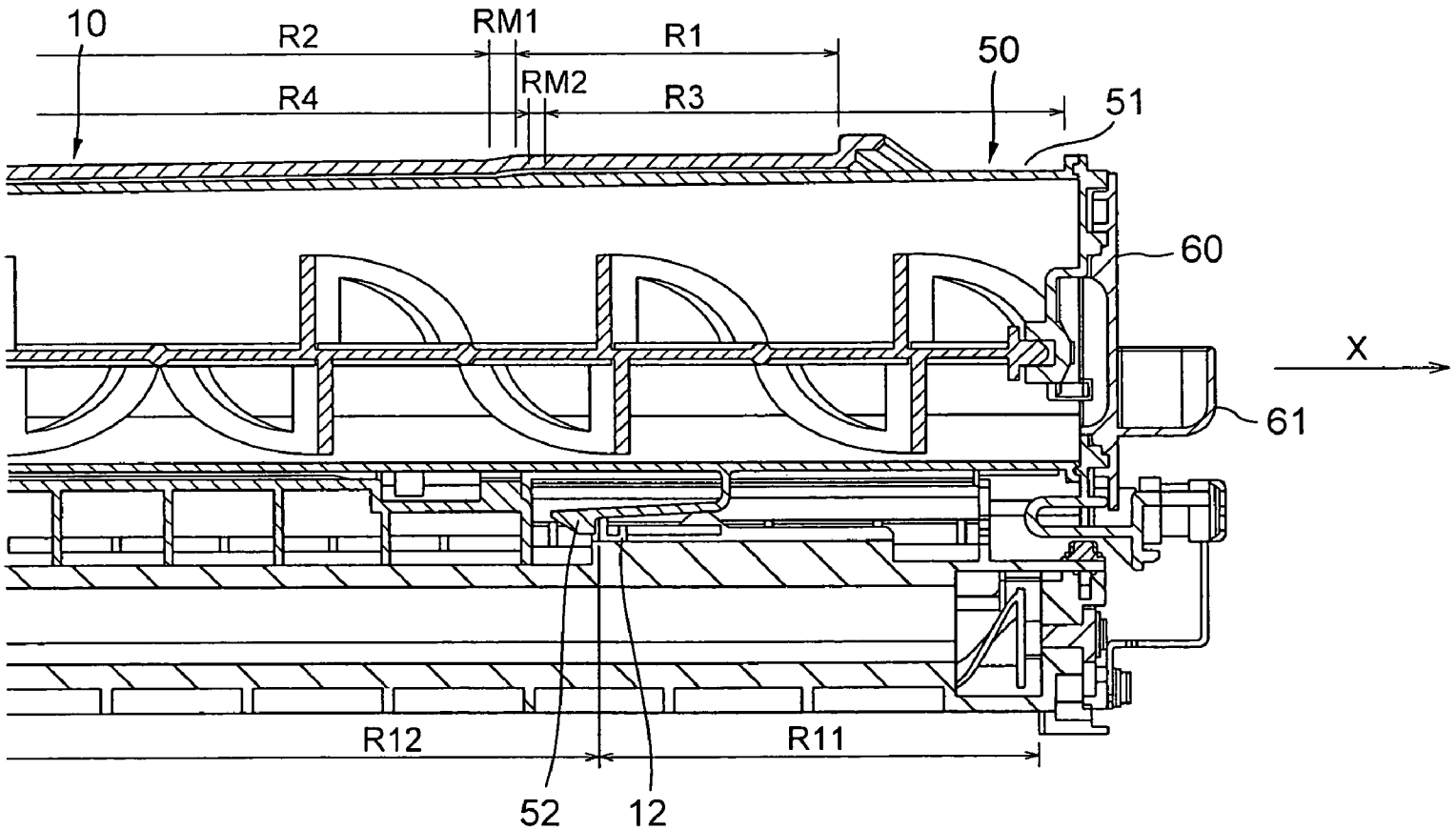
FIG. 4 is a longitudinal sectional view showing a state wherein the toner cartridge is stored in the developing device.

FIG. 4 is an enlarged longitudinal sectional view of a portion of the developing device 10 on the front end side when the toner cartridge 50 is inserted in the developing device 10.

When the toner cartridge 50 is to be loaded in the developing device 10, the shutter of the developing device 10 is opened as an end portion of the toner cartridge 50 which is located near the toner replenishment port pushes the shutter of the toner replenishment port 11 of the developing device 10. Likewise, when the shutter of the toner replenishment port of the toner cartridge 50 which is biased to close by the spring is pushed by the end portion of the developing device 10 which is located near the toner replenishment port, the shutter of the toner cartridge 50 is opened. In addition, as described above, the toner cartridge 50 has a pawl 52 for closing the shutter of the toner replenishment port 11 of the developing device 10.

Figure 5:
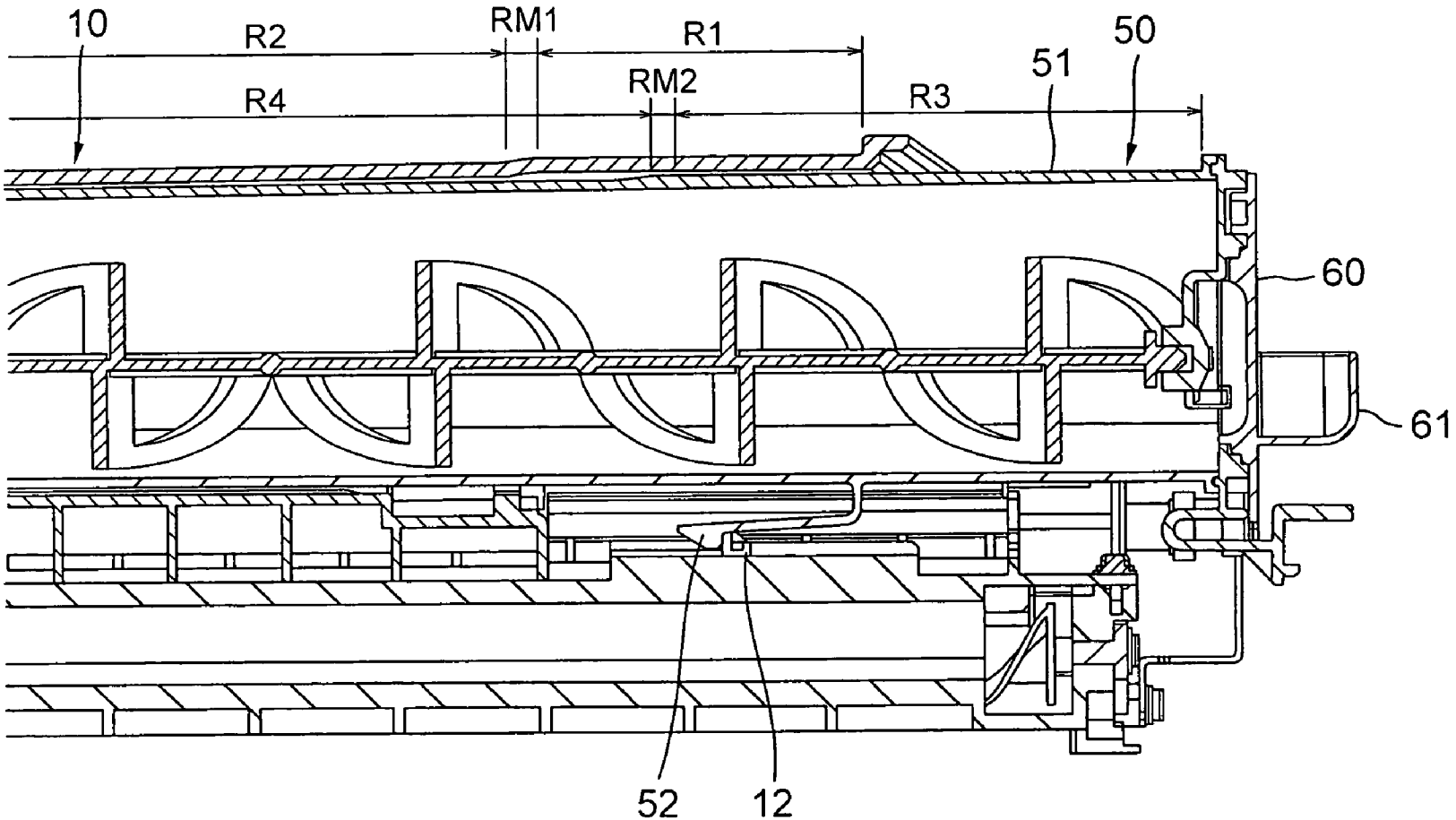
FIG. 5 is a longitudinal sectional view showing a state wherein the toner cartridge stored in the developing device is slid to be pulled out.
Figure 6B:
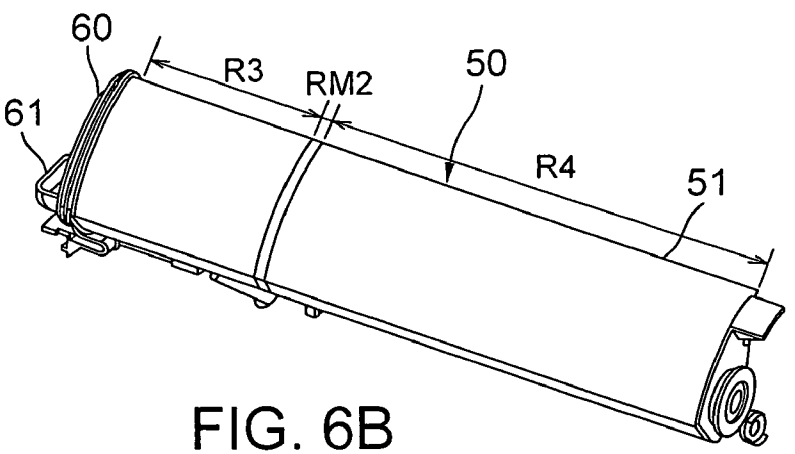
FIGS. 6A to 6D are perspective views showing the outer shape of the toner cartridge according to the first embodiment.
Figure 6A:
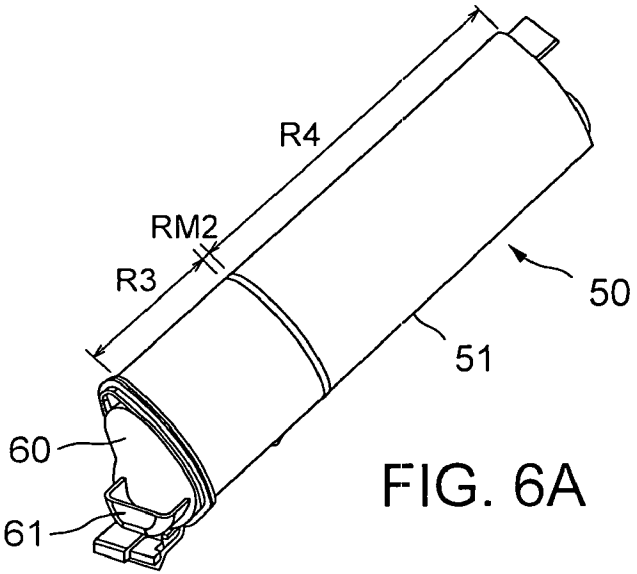
Figure 6D:
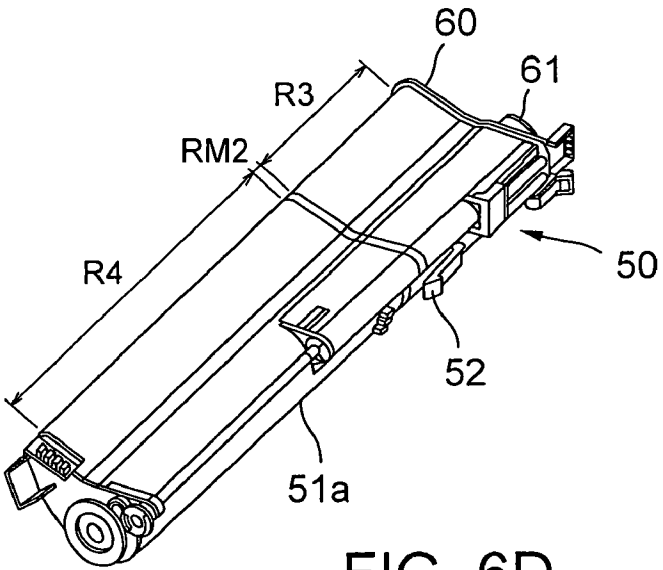
Figure 6C:
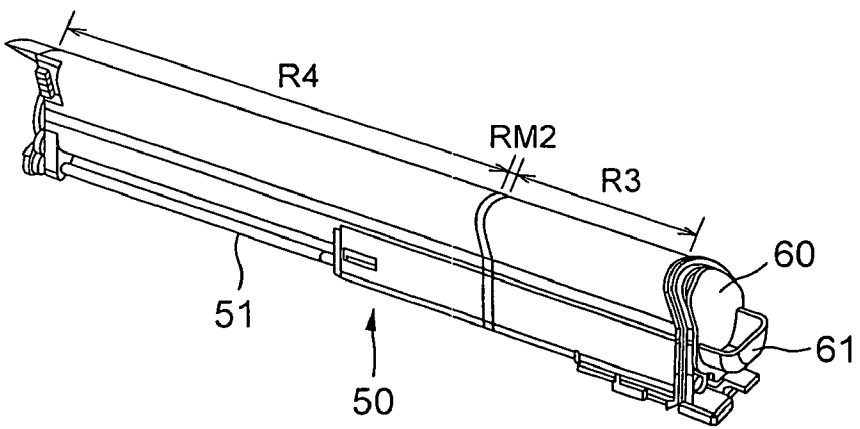

The toner cartridge 50 is removed from the developing device 10 by being pulled in the direction indicated by an arrow X. FIG. 5 is an enlarged longitudinal sectional view of portions of the developing device 10 and toner cartridge 50 which are located on the front end side in the process of removing the toner cartridge 50.

When the toner cartridge 50 is to be removed, the pawl 52 of the toner cartridge 50 is hooked on the end portion 12 near the toner replenishment port 11 of the developing device 10 and is moved in the direction to close the shutter of the toner replenishment port 11. At the position where the shutter of the toner replenishment port 11 of the developing device 10 is closed, the toner cartridge is moved so as to be raised in the direction in which the pawl 52 comes off the end portion 12 due to the inclined surface 13 formed near the toner replenishment port 11. With this operation, the toner cartridge 50 is released from the operation of closing the shutter of the developing device 10, and is removed outside the apparatus.

In this manner, the shutter of the toner replenishment port 11 of the developing device 10 is closed by the sliding movement of the toner cartridge 50 when it is removed from the apparatus. Assume that when the toner cartridge 50 is slid, backlash occurs vertically and horizontally between the toner cartridge 50 and the inner wall of the toner cartridge guide which houses the toner cartridge of the developing device 10. In this case, the pawl 52 may come off the end portion 12 of the shutter of the developing device 10, and the shutter may not reliably close.

If the shutter of the developing device 10 does not close, in a color copying machine having a plurality of developing devices mounted for the respective colors in a revolver structure, a developing agent and toner may leak in large amounts from each developing device to severely contaminate the interior of the image forming apparatus. This may adversely affect printing operation.

As described above, the outer shape of each toner cartridge is tapered in the longitudinal direction in consideration of the structure of a mold.

A toner cartridge is generally tapered at an inclination angle of about 0.5° to 3° along the longitudinal direction in the direction in which the size of the cartridge in a direction perpendicular to the longitudinal direction decreases from the front end with the lid (the front surface side of the image forming apparatus) to the rear end.

When a toner cartridge is to be loaded in a developing device, the cartridge can be inserted and fixed in the developing device without causing any backlash with respect to the inner wall of the toner cartridge guide.

When, however, a toner cartridge is slid in the direction to be removed after it is fixed, backlash occurs vertically and horizontally in the prior art. As a consequence, the end portion for closing the shutter of the toner replenishment port of the developing device is unlocked from the pawl of the toner cartridge, and the shutter does not close.

In the first embodiment, therefore, as shown in FIGS. 2A and 2B, FIGS. 4 and 5, or FIGS. 6A to 6D, an untapered region R3 having no tapered portion extends from near the front end of the toner cartridge 50, to which the lid 60 is attached, along the longitudinal direction of the outer circumferential portion of the toner cartridge 50 throughout a region R3 corresponding to the stroke length required to close the shutter of the developing device 10. A tapered region R4 extending from the untapered region R3 to near the rear end is provided to provide a draft for a mold. A region RM2 having a smooth inclination C or R exists between the untapered region R3 and the tapered region R4 to avoid a hindrance to the sliding movement of the toner cartridge 50 due to the step between the regions.

A similar untapered region R1 extends from near the front end of the developing device 10, which receives the toner cartridge 50, on the inner wall of the toner cartridge guide, throughout a portion corresponding to the untapered region R3 when the toner cartridge 50 is stored. A tapered region R2 is provided on the remaining portion. Like the toner cartridge 50, the developing device 10 has a region RM1 having a smooth inclination C or R formed between the untapered region R1 and the tapered region R2 so as to avoid a hindrance to the sliding movement of the toner cartridge 50 due to the step between the regions.

Providing the untapered regions R1 and R3 for the outer surface of the toner cartridge and the inner wall of the toner cartridge guide in this manner will prevent backlash between them when the toner cartridge is removed.

Figure 7A:
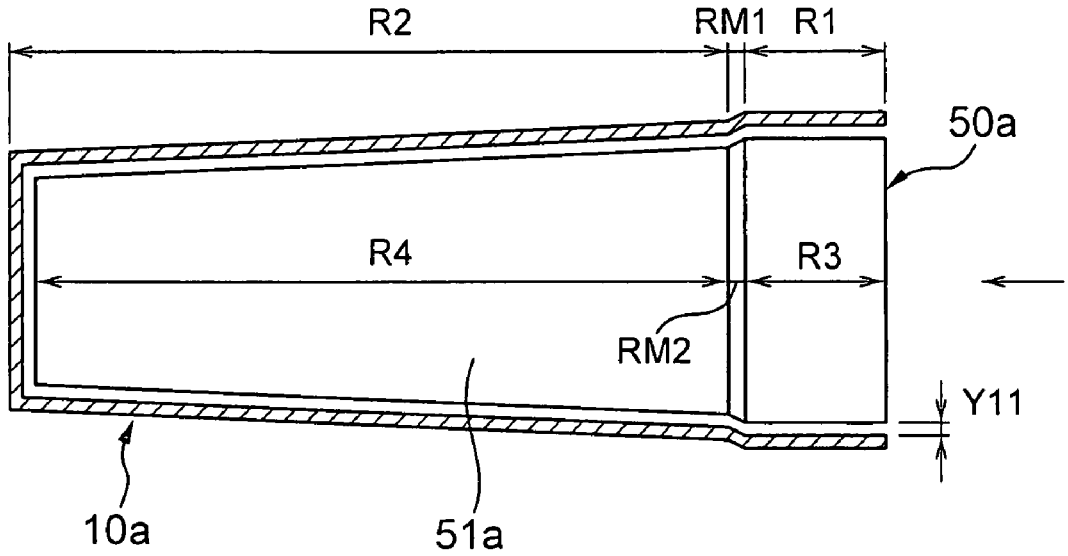
FIGS. 7A and 7B are longitudinal sectional views showing a state wherein the toner cartridge according to the first embodiment is inserted into the developing device and a state wherein the toner cartridge is pulled out.
Figure 7B:
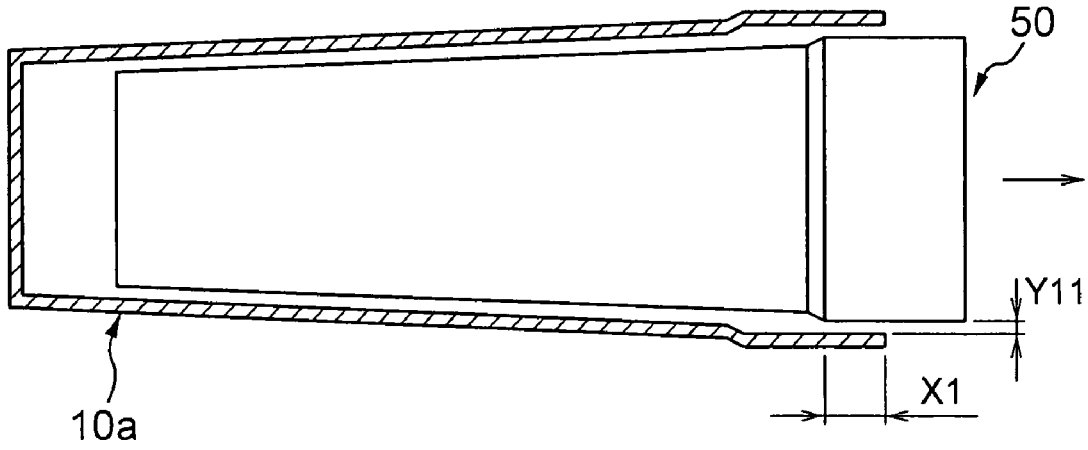

FIG. 7A shows a case wherein the toner cartridge 50 is inserted in the developing device 10 according to the first embodiment. FIG. 7B shows a case wherein the toner cartridge 50 is removed from the developing device 10.

Referring to FIG. 7A, when the toner cartridge 50 is inserted in the developing device 10 in the direction indicated by the arrow, a gap Y11 is kept constant between them, and no large amount of backlash occurs. No hindrance is caused to the operation of opening the shutter of the toner replenishment port of the toner cartridge 50 or the operation of opening the shutter of the toner replenishment port 11 of the developing device 10.

When the toner cartridge 50 inserted in the developing device 10 is removed in the direction indicated by the arrow in FIG. 7B, since the untapered region R1 of the developing device 10 and the untapered region R3 of the toner cartridge 50 are present between the inner wall of the toner cartridge guide of the developing device 10 and the outer surface of the toner cartridge 50, a gap Y1 is kept constant, and the occurrence of backlash is prevented. For this reason, the pawl 52 of the toner cartridge 50 is hooked on the end portion 12 near the toner replenishment port 11 of the developing device 10 without coming off, and can reliably close the shutter of the developing device 10 in accordance with the sliding movement of the toner cartridge 50. This can therefore prevent toner or a developing agent from leaking from the developing device 10 and contaminating the interior of the image forming apparatus.

As shown in FIG. 4, each of the untapered regions of the toner cartridge 50 and developing device 10 preferably includes a region R11 extending from near the front end of the toner cartridge 50 to the position where the pawl 52 of the toner cartridge 50 locks to the end portion 12 of the toner replenishment port 11 of the developing device 10.

As described above, the toner cartridge according to the first embodiment has an untapered region extending from near the front end to a predetermined position along the longitudinal direction of the outer circumferential portion. This prevents the occurrence of backlash between the developing device and the inner wall of the toner cartridge guide when the toner cartridge is removed from the developing device, and hence can prevent toner from leaking without causing any hindrance to the operation of closing the shutter of the toner replenishment port of the developing device.

Figure 8:
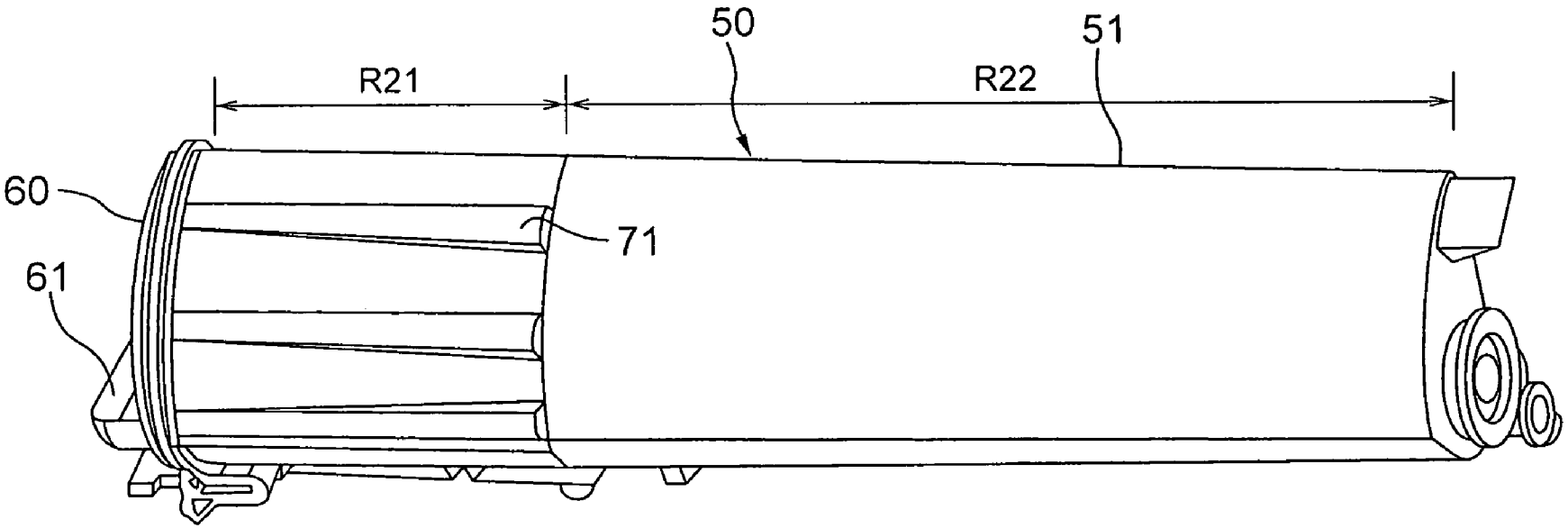
FIG. 8 is a perspective view showing the outer shape of a toner cartridge according to the second embodiment of the present invention.

The first embodiment exemplifies the present invention and does not limit the present invention. Various modifications of the embodiment can be made within the technical scope of the present invention. For example, in the first embodiment, the untapered region R3 of the toner cartridge 50 is uniformly formed throughout the entire surface of the circumference in a direction perpendicular to the longitudinal direction of the outer circumference. However, the present invention is not limited to this. As in the second embodiment of the present invention shown in FIG. 8, almost the entire region (R21+R22) extending from near the front end of a toner cartridge 50 to near the rear end is tapered, and a plurality of rib portions 71 in the form of ribs are formed on a region R11 extending from near the front end to a predetermined position such that the size of the region R11 in a direction perpendicular to the longitudinal direction becomes partially uniform. With this structure, a similar effect can be obtained.

A toner cartridge according to the third embodiment will be described next.

As described above, replacement of toner cartridges 10C, 10M, and 10Y is performed from the front side of an image forming apparatus. A revolver 115 is rotated to place one of toner cartridges 50 which needs to be replaced to a toner cartridge replacement position. The toner cartridge 50 is then removed from the revolver 115 by pulling a grip provided on a cap 60 of the toner cartridge 50, and a new toner cartridge 50 is inserted.

In order to allow the toner cartridges 50 mounted in the revolver 115 to rotate together with the revolver 115, the toner cartridges are located inside the image forming apparatus with respect to the front-side frame. For this reason, grips are provided on the toner cartridges 50 to allow the user to take out the toner cartridges 50 located inside the apparatus when they are attached/detached.

Figure 9:
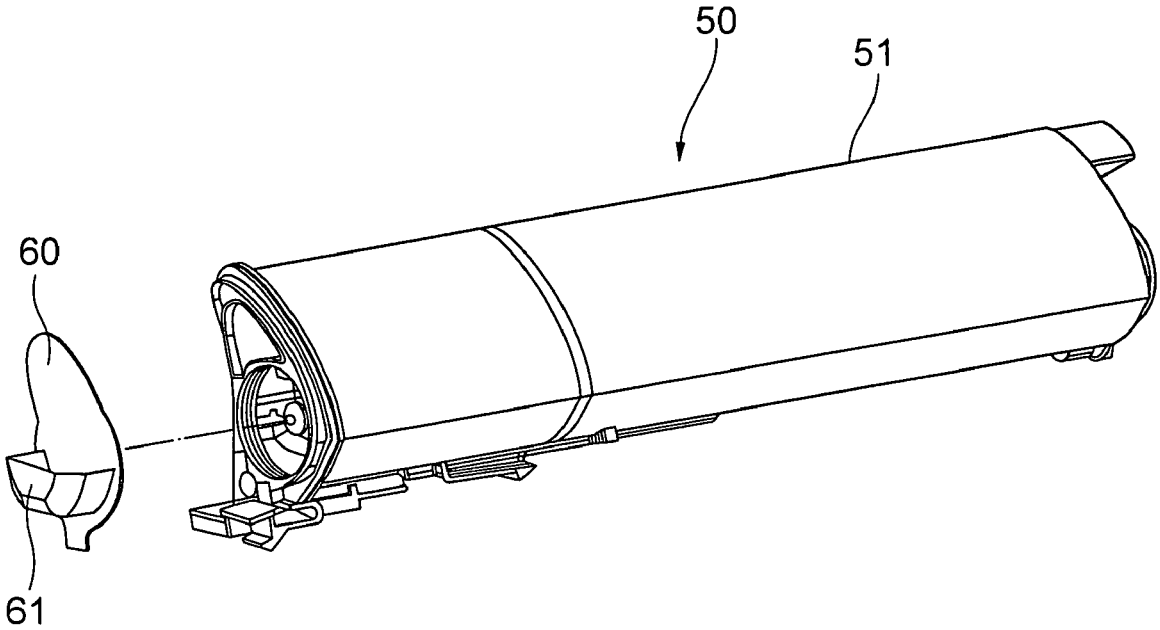
FIG. 9 is a perspective view showing a state wherein a cap is mounted on the casing of a toner cartridge according to the third embodiment of the present invention.

FIG. 9 shows the outer appearance of the toner cartridge 50 according to the third embodiment of the present invention. The toner cartridge 50 includes a casing 51 having an opening in one end and the cap 60 for sealing the opening portion of the casing 51. As described above, the cap 60 has a grip 61.

FIG. 9 shows a state before the cap 60 is attached to the casing 51 of the toner cartridge 50. The casing 51 has a hollow portion in which toner is contained. After toner is contained in the hollow portion, the portion is sealed with the cap 60.

Figure 10:
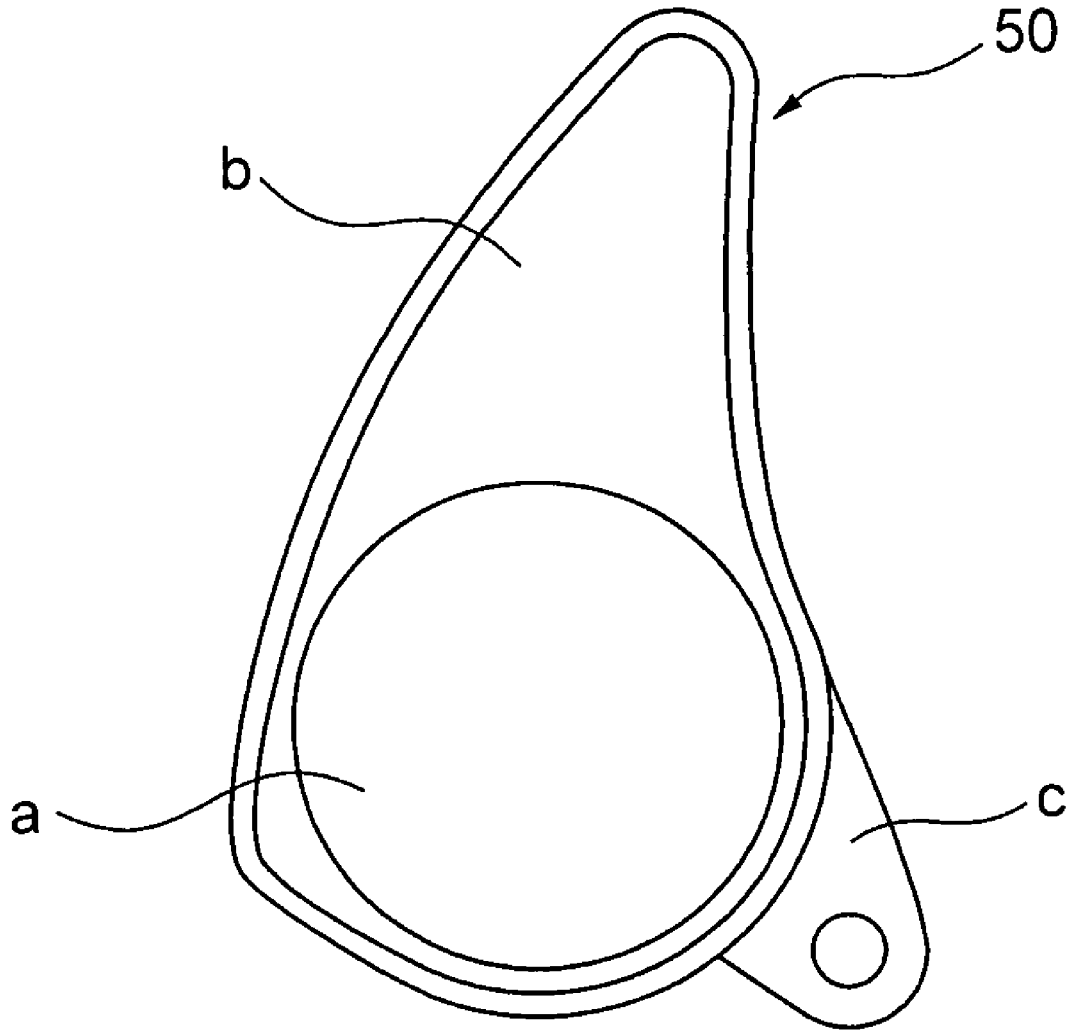
FIG. 10 is a side view of the toner cartridge.

In this case, the toner cartridge 50 has a first portion a, second portion b, and third portion c, as shown in FIG. 10, which shows the schematic arrangement of a side surface of the toner cartridge 50 which is located opposite to a side surface on which the cap 60 is provided.

The first portion a extends in the longitudinal direction, has a substantially cylindrical shape, and contains toner. The second portion b extends in the longitudinal direction and has a substantially triangular shape integrally formed with the first portion a. The third portion c extends in the longitudinal direction and is integrally formed with at least part of the first portion a.

Figure 11:
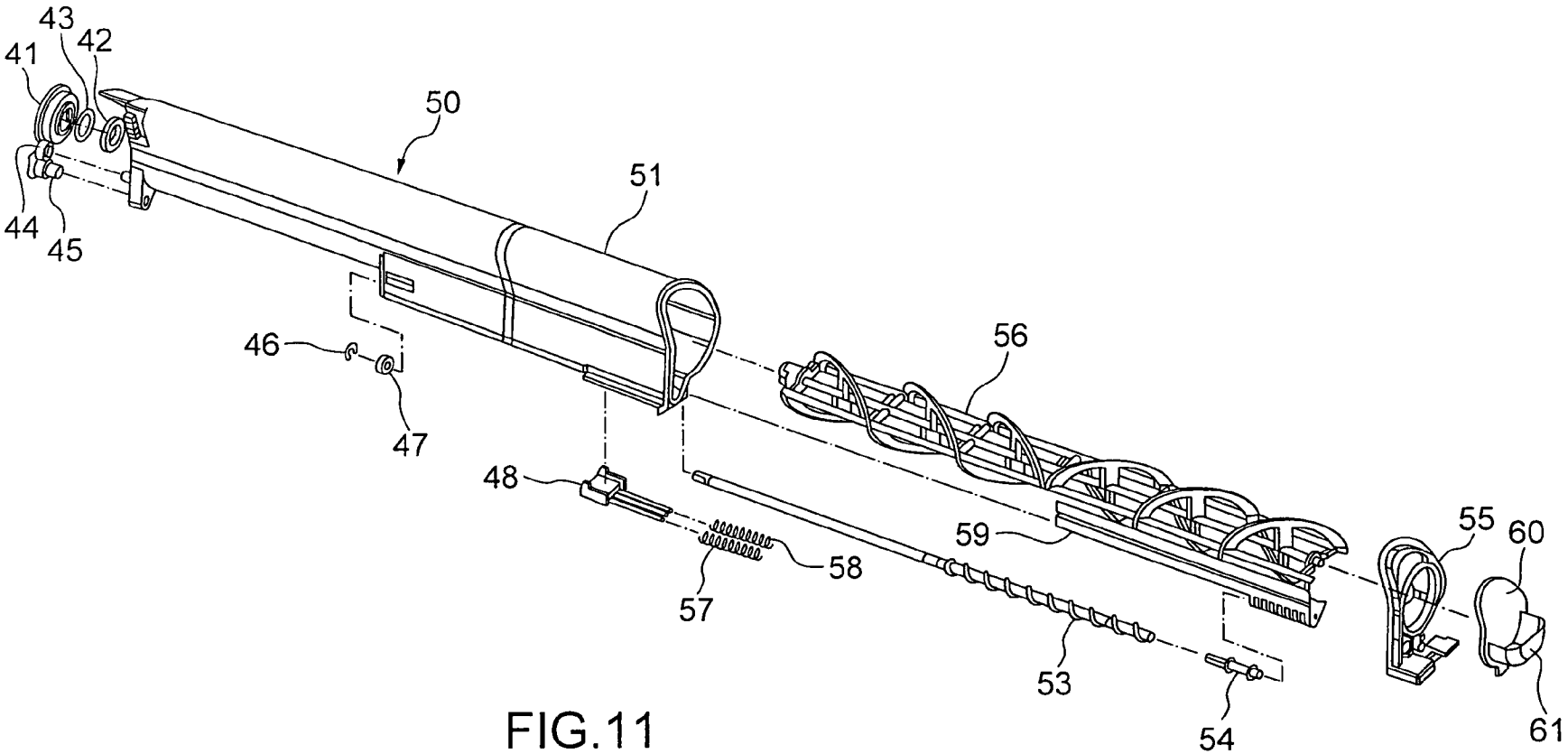
FIG. 11 is a perspective view showing the inner structure of the toner cartridge.

FIG. 11 is an exploded view of the toner cartridge 50. The casing 51 houses a paddle 56 for agitating toner and moving it to the center of the casing 51, an auger 53 for carrying toner to near the toner supply port, an auger roof 59 which covers the auger 53, and a valve 54 for fixing the auger 53 to the auger roof 59.

A paddle gear 41 for rotating the paddle 56, a felt 42, a washer 43, and an idle gear and coupling 45 are mounted on one end face of the casing 51. An opening member 55 and the above cap 60 are mounted on the other end face of the casing 51.

A toner supply port (not shown) for supplying toner into a developing device 10 and a shutter 48 which is biased by springs 57 and 58 to close the toner supply port are provided on a lower portion of the casing 51 which is located near its front surface (the front surface side of the image forming apparatus).

When the toner cartridge 50 is to be assembled, the casing 51 is filled with toner in the state shown in FIG. 9, and the cap 60 is then attached to the casing to seal it so as to prevent the toner from spilling out. The cap 60 can be attached to the casing by any fixing method such as press fitting, boding, or welding.

The toner cartridge 50 having the above structure in the third embodiment is characterized in that the cap 60 is formed from a transparent member. This allows the user to visually check the color of toner inside the toner cartridge 50 at the toner cartridge replacement position when it is replaced. That is, the user can replace a necessary toner cartridge without mistake upon easily and visually checking the toner color as one of the three colors (C, M, and Y).

According to the third embodiment, the indispensable cap 60 is formed from a transparent member. Therefore, unlike the prior art in which a window formed from a transparent member or the like is provided for a casing to check the color of toner, there is no need to add a new member for a window other than indispensable members for a toner cartridge such as a casing and cap. This can achieve a reduction in cost.

Figure 12:
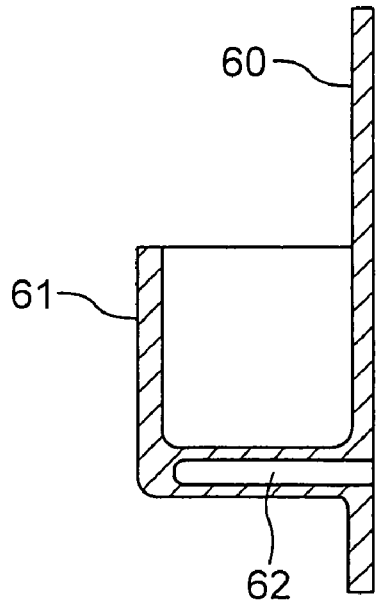
FIG. 12 is a longitudinal sectional view showing the structure of the cap of the toner cartridge.

As shown in FIG. 12, the sectional shape of the grip 61 provided on the cap 60 preferably has a hollow portion 62 open to the side where the grip is mounted on the casing 51. The formation of the hollow portion 62 allows toner to be guided into the hollow portion 62. This makes it possible to discriminate the color of the toner more reliably.

Figure 13:
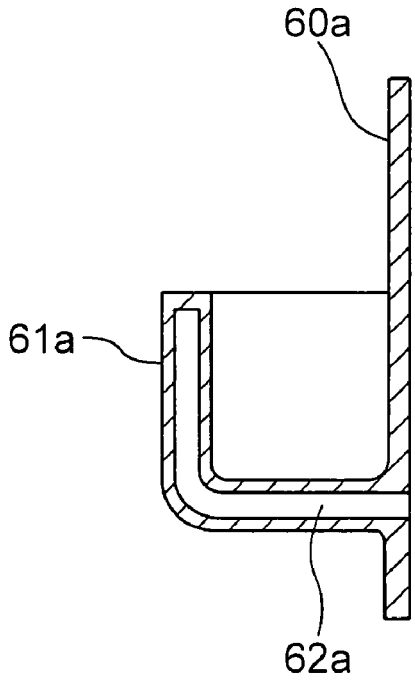
FIG. 13 is a longitudinal sectional view showing another structure of the cap of the toner cartridge.

In this case, the hollow portion 62 may have a shape different from that shown in FIG. 12. For example, like a cap 60*a* shown in FIG. 13, a hollow portion 62*a* may be formed throughout almost the entire L-shaped cross-section of a grip 61*a*.

Figure 15A:
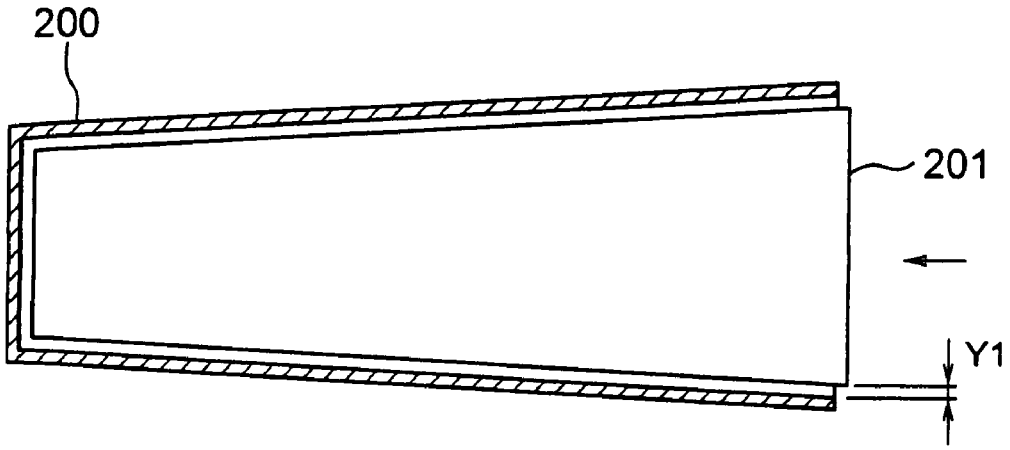
FIG.15A Prior Art
FIGS. 15A and 15B are longitudinal sectional views showing a state wherein a conventional toner cartridge is inserted into a developing device and a state wherein the toner cartridge is pulled out.

As described with reference to FIGS. 15A and 15B, a draft is provided on each of the outer surface of the conventional toner cartridge 201 and the inner wall of the developing device 200 throughout almost the entire region from near the front end on the right side in FIG. 15A or 15B (on the front surface side of the image forming apparatus) to near the rear end on the left side in FIG. 15A or 15B in consideration of the shape of a mold for injection molding in order to ensure easy mold release in the mold moving direction (longitudinal direction).

Figure 15B:
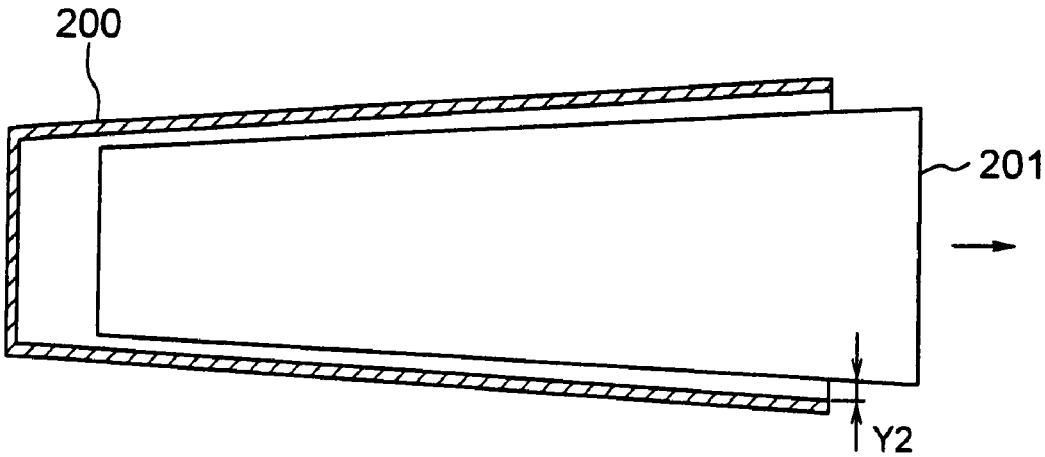
FIG.15B Prior Art

With such tapered outer shapes, when the toner cartridge 201 inserted in the developing device 200 is removed in the direction indicated by the arrow in FIG. 15B, the gap Y2 larger than the gap Y1 is produced between the inner wall of the developing device 200 and the outer surface of the toner cartridge 201, resulting in a large amount of backlash. The shutter of the toner replenishment port of the developing device 200 cannot be closed because the pawl of the toner cartridge 201 comes off the end portion near the shutter of the toner replenishment port of the developing device 200. As a consequence, toner may leak from the developing device and contaminate the interior of the image forming apparatus.

The fourth embodiment of the present invention to be described below is directed to a toner cartridge and developing device having the same arrangements as those of the first and second embodiments, in addition to the arrangement of the third embodiment, to prevent backlash between the toner cartridge and the developing device when the cartridge is removed, and to reliably close the shutter of the toner replenishment port of the developing device.

The casing of a toner cartridge is shaped to have a draft from near the front end to near the rear end in consideration of the shape of a mold for injection molding so as to ensure easy mold release in the molding moving direction, i.e., the longitudinal direction of the casing.

Figure 14B:
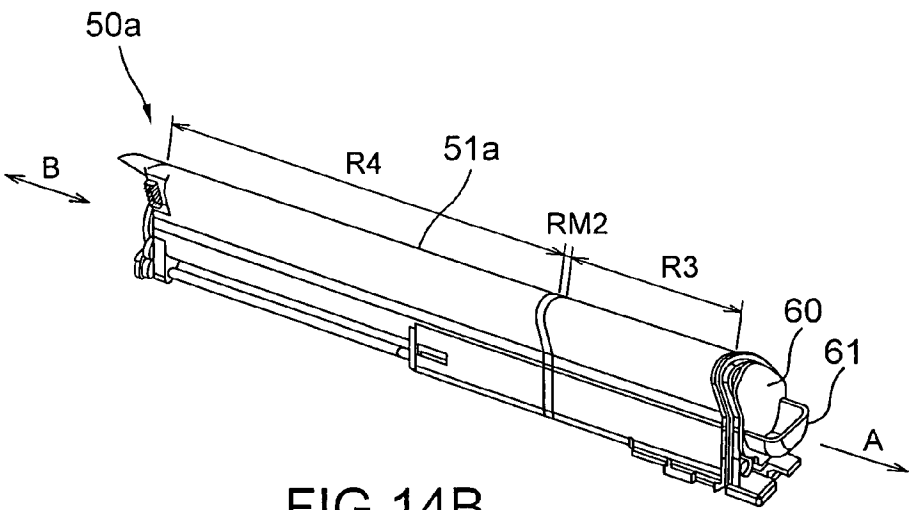
FIGS. 14A and 14B are perspective views showing the outer shapes of a toner cartridge and developing device according to the fourth embodiment of the present invention.
Figure 14A:
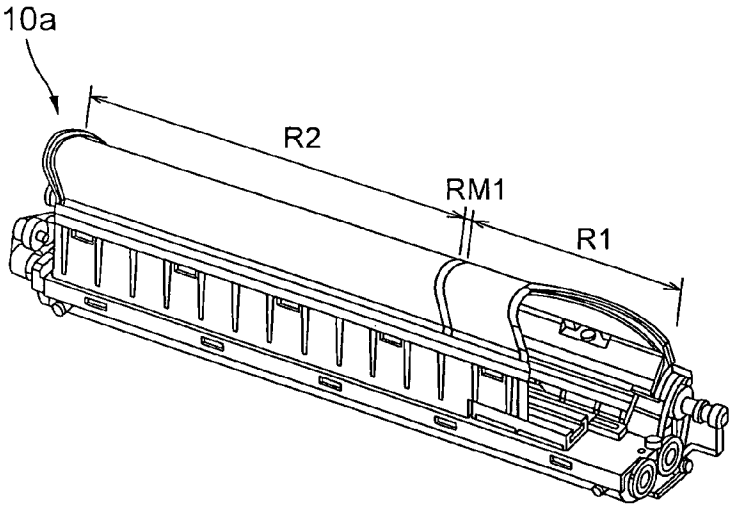

As shown in FIG. 14A, a developing device 10*a* of the image forming apparatus has a hollow portion for housing a toner cartridge 50*a*. The toner cartridge 50*a* in FIG. 14B is inserted in the hollow portion of the developing device 10*a* of the toner cartridge 50*a*. The toner cartridge 50*a* has a casing 51*a* having a hollow portion inside in which toner is contained and a cap 60 which closes the opening portion of the front end of the casing 51*a*. The cap 60 has a grip 61 which is to be pulled by the operator in the direction indicated by an arrow A. When the toner cartridge 50*a* slides in the longitudinal direction as indicated by an arrow B, the cartridge is attached/detached to/from the developing device 10*a*.

As in the third embodiment, the cap 60 having the grip 61 is formed from a transparent member.

The following are the same as described in the first embodiment: the operation to be performed when toner in the toner cartridge 50*a* in the fourth embodiment moves to the developing device 10*a* to be replenished; the state in which the toner cartridge 50*a* is loaded in the developing device 10*a*; the state in which the toner cartridge 50*a* is pulled out of the developing device 10*a*; the state in which the toner cartridge 50*a* slides on the inner wall of the toner cartridge guide in the developing device 10*a*; and the effects of the tapered and untapered regions of the toner cartridge 50*a* on the insertion or removal of the cartridge from the developing device 10*a*. A description of them will therefore be omitted.

The fourth embodiment may have the same arrangement as that in the second embodiment. That is, almost the entire region (R21+R22) extending from near the front end of a casing 51*b* of a toner cartridge 50*b* to near the rear end may be tapered, and a plurality of rib portions 71 in the form of ribs may be formed on a region R11 extending from near the front end to a predetermined position such that the size of the region R11 in a direction perpendicular to the longitudinal direction becomes partially uniform.

The third and fourth embodiments exemplify the present invention and do not limit the present invention. Various modifications of the embodiments can be made within the technical scope of the present invention.

For example, the shapes of the toner cartridge, cap, and grip may differ from those in the first embodiment.

Forming the cap using a transparent member, which is used to seal the opening portion of the casing of the toner cartridge according to the third and fourth embodiments, can prevent an increase in cost due to the addition of a new member.

Forming untapered regions on the toner cartridge and developing device, each of which extends from near the front end to a predetermined position along the longitudinal direction of the outer circumferential portion, can prevent backlash between the toner cartridge and the inner wall of the toner cartridge guide of the developing device when the cartridge is removed from the developing device. This therefore makes it possible to prevent toner from leaking without causing any hindrance to the operation of closing the shutter of the toner replenishment port of the developing device.

What is claimed is:

1. A toner cartridge exchangeably inserted into a revolver and replenishing toner into a replenishment port of a developing device in the revolver, comprising:

a toner container containing toner therein, having a predetermined length along a direction of being inserted into the revolver, at least one end surface of the toner container along a direction of being inserted into the revolver having:

a first portion in which a portion of an outer shape thereof has a substantial cylindrical shape, which enables to contain a cylinder having a predetermined diameter, a second portion provided upward to the first portion having a substantial triangular shape, whose one side has a curvature along the outer shape of the revolver, and whose bottom is shorter than the predetermined diameter, and a third portion unified with at least one portion of the first portion; and a grip which allows the toner cartridge to be pulled out from the revolver.

2. A toner cartridge according to claim 1, wherein the toner cartridge further comprises a rotary mixer facing the first portion, having a predetermined diameter.

3. A toner cartridge according to claim 1, wherein the third portion is provided with a screw.

4. A toner cartridge according to claim 1, wherein the grip has a L shape cross sectional surface.

5. A toner cartridge exchangeably inserted into a revolver and replenishing toner into a replenishment port of a developing device in the revolver, comprising:

a toner container which contains toner therein, having a predetermined length along a direction of being inserted into the revolver, in which at least one end surface along a direction of being inserted into the revolver has a predetermined curvature fitted to an outer shape of the revolver; and a grip provided on the one end surface, whose a cross sectional view has a L shape along a direction being inserted into the toner cartridge, at least one end surface of the toner container along a direction of being inserted into the revolver having:

a first portion in which a portion of an outer shape thereof has a substantial cylindrical shape, and can contain a cylinder having a predetermined diameter, a second portion provided upward to the first portion having a substantial triangular shape, whose one side has a curvature along the outer shape of the revolver, and whose bottom is shorter than the predetermined diameter, and a third portion unified with at least one portion of the first portion.

6. A toner cartridge according to claim 5, wherein at least upward portion of the grip allows discrimination of a color of a toner contained in the toner container.

7. A toner cartridge exchangeably inserted into a revolver and replenishing toner into a replenishment port of a developing device in the revolver, comprising:

a toner container containing toner therein, having a predetermined length along a direction of being inserted into the revolver;

a grip provided on the one end surface, whose a cross sectional surface has a L shape along a direction being inserted into the toner cartridge; and a window provided at least upward the grip which allows discrimination of a color of a toner contained in the toner container, at least one end surface of the toner container along a direction of being inserted into the revolver having:

a first portion in which a portion of an outer shape thereof has a substantial cylindrical shape, and can contain a cylinder having a predetermined diameter, a second portion provided upward to the first portion having a substantial triangular shape, whose one side has a curvature along the outer shape of the revolver, and whose bottom is shorter than the predetermined diameter, and a third portion unified with at least one portion of the first portion.

8. A toner cartridge according to claim 7, wherein the grip has a L shape cross sectional surface.

9. A toner cartridge according to claim 7, wherein the toner cartridge further comprises a rotary mixer facing the first portion, having a predetermined diameter.

10. A toner cartridge according to claim 7, wherein the third portion is provided with a screw.

* * * * *